US010400435B2

(12) United States Patent
Nivelles

(10) Patent No.: US 10,400,435 B2
(45) Date of Patent: Sep. 3, 2019

(54) CONNECTING MEANS FOR CONNECTING A DISCHARGE PIPE TO A DISCHARGE OPENING

(71) Applicant: **Geni*us BVBA**, Tienen (BE)

(72) Inventor: Geert Nivelles, Tienen (BE)

(73) Assignee: **GENI*US BVBA**, Tienen (BE)

( * ) Notice: Subject to any disclaimer, the term of this patent is extended or adjusted under 35 U.S.C. 154(b) by 1 day.

(21) Appl. No.: 14/917,071

(22) PCT Filed: Sep. 12, 2014

(86) PCT No.: PCT/IB2014/064465
§ 371 (c)(1),
(2) Date: Mar. 7, 2016

(87) PCT Pub. No.: WO2015/036968
PCT Pub. Date: Mar. 19, 2015

(65) Prior Publication Data

US 2016/0194861 A1 Jul. 7, 2016

(30) Foreign Application Priority Data

Sep. 13, 2013 (BE) ..... 201300604

(51) Int. Cl.
*E03F 5/04* (2006.01)

(52) U.S. Cl.
CPC ..... *E03F 5/0408* (2013.01); *E03F 5/0407* (2013.01); *E03F 2005/0415* (2013.01)

(58) Field of Classification Search
CPC ..... E03F 5/0408; E03F 5/0407; E03F 2005/0415
USPC ..... 285/56, 57, 64, 325; 4/252.3, 679, 695; 137/362
See application file for complete search history.

(56) References Cited

U.S. PATENT DOCUMENTS 831,429 A * 9/1906 Harrington ..... F16L 41/02 285/325 X
2016/0265203 A1* 9/2016 Knapp ..... E03F 5/0408

FOREIGN PATENT DOCUMENTS

EP 0 559 085 A1 * 2/1993
EP 0 559 085 A1 * 2/1999
EP 1674629 A2 6/2006
EP 2325406 A1 5/2011

* cited by examiner

*Primary Examiner* — Greg Binda
(74) *Attorney, Agent, or Firm* — GableGotwals

(57) ABSTRACT

Connecting means for connecting a discharge pipe to a discharge opening of a sanitary installation. The means includes a longitudinal cover plate having a connecting opening for connecting a discharge pipe, a guide in which the cover plate can move to and fro according to its length, and a seal to directly or indirectly seal the movable cover plate in relation to the discharge opening of the sanitary installation.

9 Claims, 6 Drawing Sheets

CONNECTING MEANS FOR CONNECTING A DISCHARGE PIPE TO A DISCHARGE OPENING

CROSS-REFERENCE TO RELATED APPLICATIONS

This application is the United States National Phase of PCT Application No. PCT/IB2014/064465 filed 12 Sep. 2014, which claims priority to Belgium Patent Application No. BE201300604 filed 13 Sep. 2013, each of which is incorporated herein by reference.

STATEMENT REGARDING FEDERALLY SPONSORED RESEARCH

Not Applicable

PARTIES TO JOINT RESEARCH AGREEMENT

Not Applicable

REFERENCE TO SEQUENCE LISTING

Not Applicable

The present invention first and foremost concerns connecting means for connecting a discharge pipe to a discharge opening of a sanitary installation.

Connecting means according to the invention prove to be highly useful in sanitary installations such as showers, bath tubs and the like, whereby there is little room for connecting a discharge pipe and obstacles often make the connection difficult or impossible.

Nevertheless, such connecting means according to the invention can equally well be applied in sanitary installations where lack of space is usually a less pressing problem, such as in sinks or wash basins and the like, for example also with the intention to avoid certain obstacles or to simply facilitate the connection of the drain, or for purely aesthetic reasons and so on.

Of the type being referred to, there are already many known sorts according to the present state of the art, but they have certain disadvantages.

In the conventional sanitary applications, a ready-made discharge opening is provided having approximately the dimensions of the discharge pipe which is to be connected to the latter.

In order to avoid odour nuisance, a trap is usually placed on said discharge opening; in showers and bath tubs it will usually have the shape of a bottle trap because of the lack of space, in sinks and wash basins the trap will rather have the shape of a so-called swan neck.

In this text is understood by discharge pipe the assembly comprising one or several waste pipes or hoses draining water from the discharge opening, including parts such as the aforesaid bottle trap and the like.

In these known sanitary installations, the position of the discharge opening is usually fixed and non-adjustable.

Also, the discharge pipe must be inevitably led to the discharge opening so as to be connected directly to the discharge opening of the sanitary installation.

In many cases, however, this is problematic.

A typical example of such a problematic case is the installation of a shower tray on a wooden floor, whereby a supporting beam of the wooden floor is situated just below the discharge opening and whereby changing the position of such a supporting beam or removing it as a whole or in part is not an option.

Also in many other cases, obstacles may hamper the connection of a discharge pipe to a discharge opening, such as obstacles in the shape of other pipes such as water pipes and power lines, metal supporting beams or supporting beams made of reinforced concrete.

In the case of wash basins and sinks it is moreover customary to provide storage space under the wash basin or sink.

The size of said storage space is often severely limited, however, due to the presence of a discharge pipe which is to be connected centrally in the storage space, which is an additional disadvantage of the classical solutions.

Connecting means are known from EP2325406 and EP1674629 which are provided with sliding portions making it possible to somewhat position a discharge opening in a sanitary installation, in particular an opening in a tile floor, above a discharge pipe that has already been applied.

The extent to which the discharge opening can be positioned using these known connecting means is extremely limited, nor do these known connecting means offer a solution to the conventional case in which a shower tray, shower drain or wash basin is provided with a ready-made discharge opening whose position often cannot be altered and onto which the far end of a discharge pipe must be connected, regardless of any possible presence of underlying obstacles at the discharge opening.

In short, with these known connecting means, the discharge opening at the top of the sanitary installation or receptacle can be shifted as a function of the tiles that are present by making a movement, but the location of the connection to the discharge pipe at the bottom of the sanitary installation cannot be adjusted.

From US2009119831 are known still other connecting means for connecting a discharge pipe to a discharge opening of a shower tray.

The discharge opening in this case is a circular opening, whereby the connecting means are formed of a circular cover plate having the same dimensions as the circular discharge opening and whereby a connecting opening is eccentrically provided in the cover plate for connecting a discharge pipe.

By rotating the cover plate in the discharge opening at a certain angle, it becomes possible to position the connecting opening in the cover plate to a limited extent, so that also the far end of the discharge pipe can be positioned in the discharge opening.

A first major disadvantage of these connecting means is that the extent to which the connecting opening can be positioned in the discharge opening is very limited, since the connecting opening can only be positioned on a circle around the centre of the discharge opening having a radius corresponding to the eccentricity with which the connecting opening is provided in the cover plate.

Also, the maximum shift of the connecting opening to be achieved is twice the aforesaid eccentricity.

Another major disadvantage of these known connecting means is that the round design of the cover plate cannot be used in the usually elongated gutters of so-called walk-in showers, which only have a limited width.

BRIEF SUMMARY OF THE INVENTION

Also, the present invention aims to remedy one or several of the aforesaid and/or other disadvantages.

In particular, the invention aims among other things to make it possible to install a shower bottom, shower tray or the like, incorporated or placed on a floor, whereby obstacles such as for example supporting beams under the sanitary installation can be by-passed without any problems.

An object of the invention is thus to obtain connecting means whereby the location of the connection to the discharge pipe at the bottom of the sanitary installation or receptacle can be altered, whereas the discharge opening remains unchanged.

To this end, the invention concerns connecting means for connecting a discharge pipe to a discharge opening of a sanitary installation, whereby the connecting means comprise at least the following elements:

- a longitudinal cover plate in which is provided a connecting opening;
- a guide in which the cover plate can be provided such that it can move to and fro according to its length; and,
- a dynamic seal for directly or indirectly sealing the movable plate-like element in relation to the discharge opening of the sanitary installation.

A major advantage of such connecting means according to the invention is that they are provided with a longitudinal cover plate which can move to and fro and which allows by its shape to reposition the connecting opening provided in it over a relatively large distance, making it easy to by-pass obstacles such as supporting beams under showers.

Indeed, the far end of a discharge pipe, whether or not incorporating a trap, is connected to the connecting opening, or said far end of the discharge pipe is already provided on the connecting opening at the manufacturing stage of the connecting means.

Also, connecting means according to the invention make it possible to position the far end of a discharge pipe in the discharge opening by shifting the cover plate in the guide of the connecting means.

Indeed, the object is that the dimensions of the outer contours of the cover plate are substantially larger than the discharge opening of the sanitary installation, and this mainly in the longitudinal direction of the cover plate, to make the aforesaid positioning possible.

Another advantage of connecting means according to the invention is that the sliding arrangement of the cover plate is very easy to use and hardly requires any action of an installer during the assembly of a discharge pipe.

Yet another advantage of connecting means according to the invention is that they can be made very aesthetically looking in a very simple manner.

According to a preferred embodiment of connecting means according to the invention, the connecting opening is provided centrally in the cover plate.

Such an embodiment offers the advantage that the possibilities for positioning the connecting opening in the discharge opening of the sanitary installation by moving the cover plate back and forth in relation to the discharge opening are maximized.

According to the invention it is not excluded for the aforesaid guide of the connecting means to be part of the sanitary installation, for example by taking this immediately into account at the production stage of the sanitary installation.

Thus, for example, the necessary provisions can be made on the edges of a discharge opening of a shower tray so as to be able to accommodate the cover plate in a sliding manner.

The invention further also concerns a connection set forming connecting means, as described above, whereby this connection set comprises a guide in the shape of a separate guiding element which can be connected to the sanitary installation concerned.

A major advantage of such a connection set consists in that the guide can be mounted as separate on the opening, so that the sanitary installation only needs to be provided with a discharge opening during the manufacture.

Finally, the invention also concerns a sanitary installation with a discharge opening onto which is connected a discharge pipe by means of connecting means of a connection set, as described above, and whereby the discharge pipe leads to the connecting opening of the cover plate, which plate-like element is provided slidably in the guide, but is sealed in relation to the discharge opening on the sanitary installation either directly or indirectly via an intermediate guiding element.

BRIEF DESCRIPTION OF THE DRAWINGS

In order to better explain the characteristics of the invention, the following preferred embodiments of connecting means according to the invention are described by way of example only without being limitative in any way, as well as a connection set and a sanitary installation according to the invention, with reference to the accompanying drawings, in which.

DETAILED DESCRIPTION OF THE INVENTION

Figure 1:
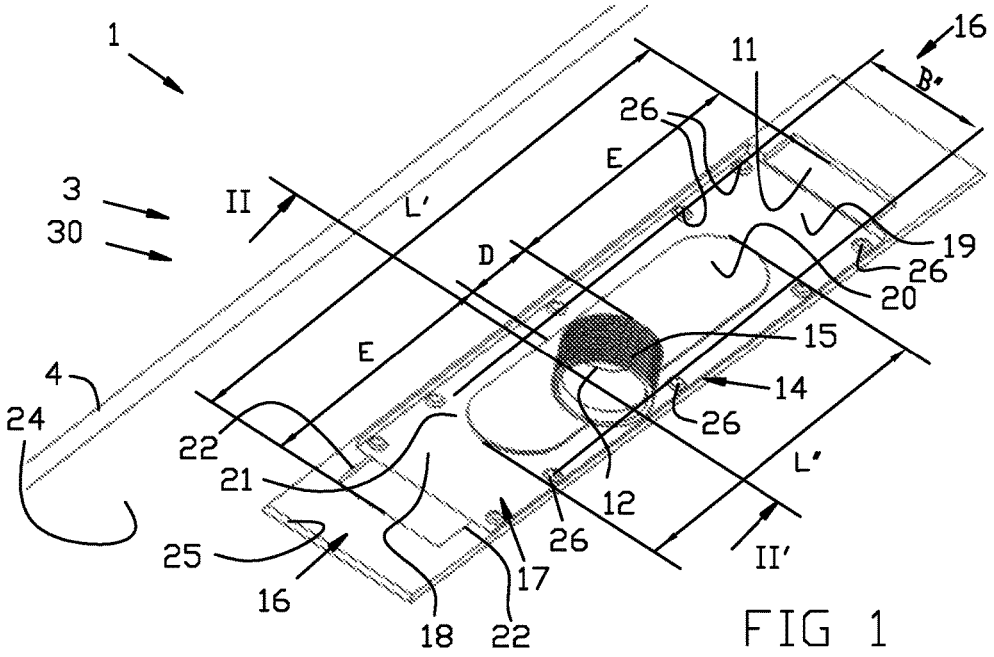
FIG. 1 shows a view in perspective of a first embodiment of connecting means according to the invention, in particular a bottom view of a discharge opening of a sanitary installation according to the invention.
Figure 2:
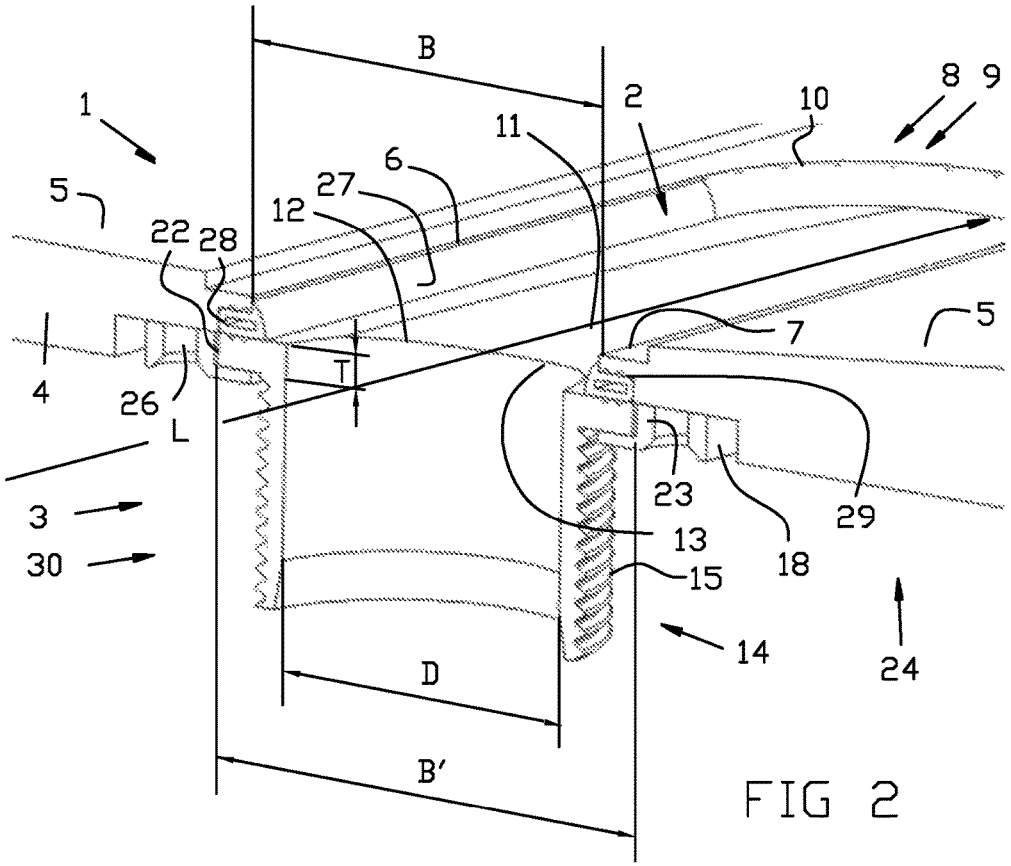
FIG. 2 shows a section according to line II-II' through the discharge opening of FIG. 1, seen in perspective.
Figure 3:
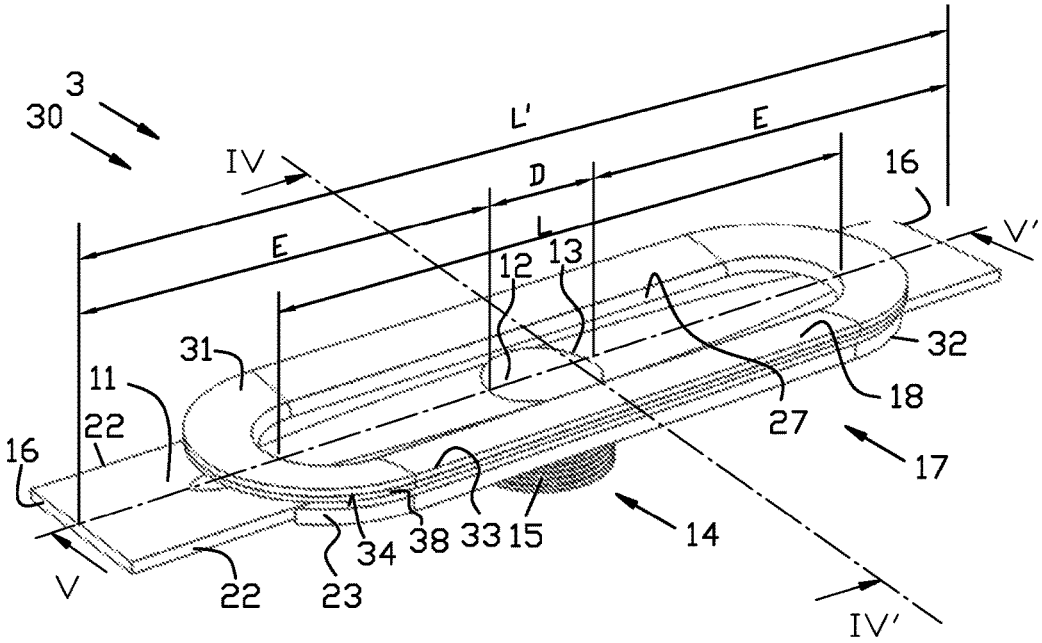
FIG. 3 shows a view from above of a second embodiment of connecting means according to the invention, as assembled, seen in perspective.
Figure 4:
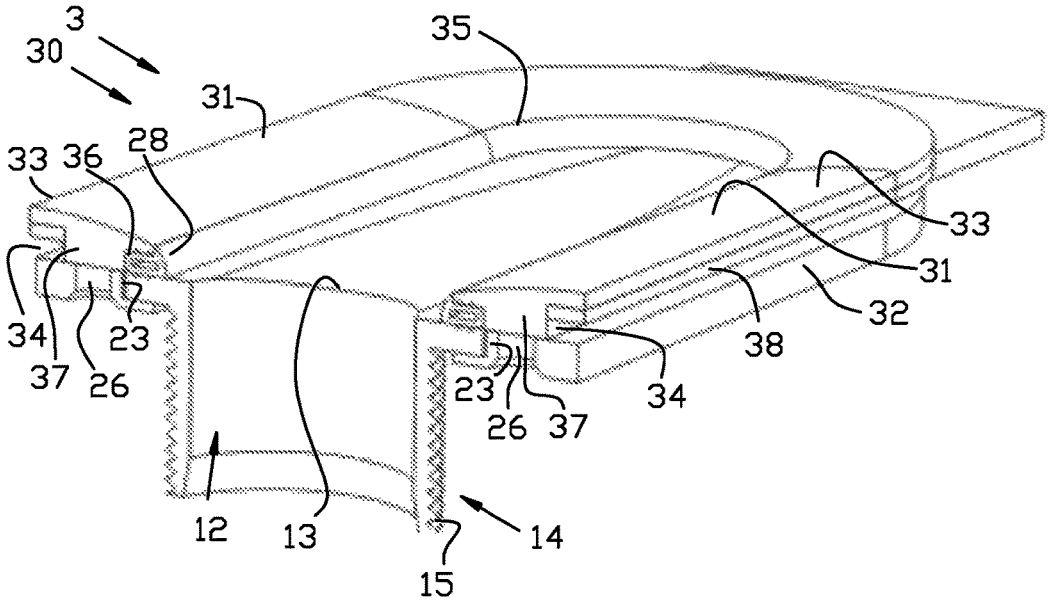
FIGS. 4 and 5 are cross-sections according to line IV-IV' and line V-V' respectively through the connecting means of FIG. 3, seen in perspective.
Figure 5:
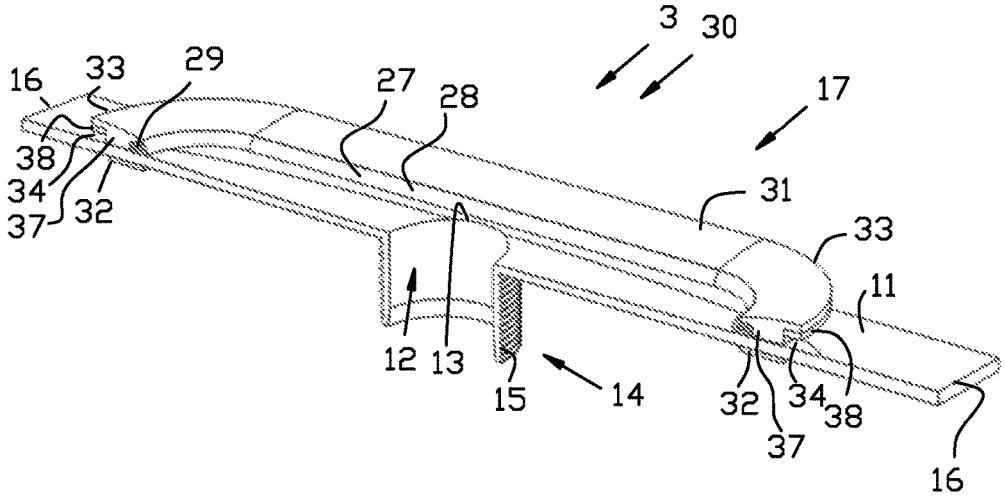
Figure 6:
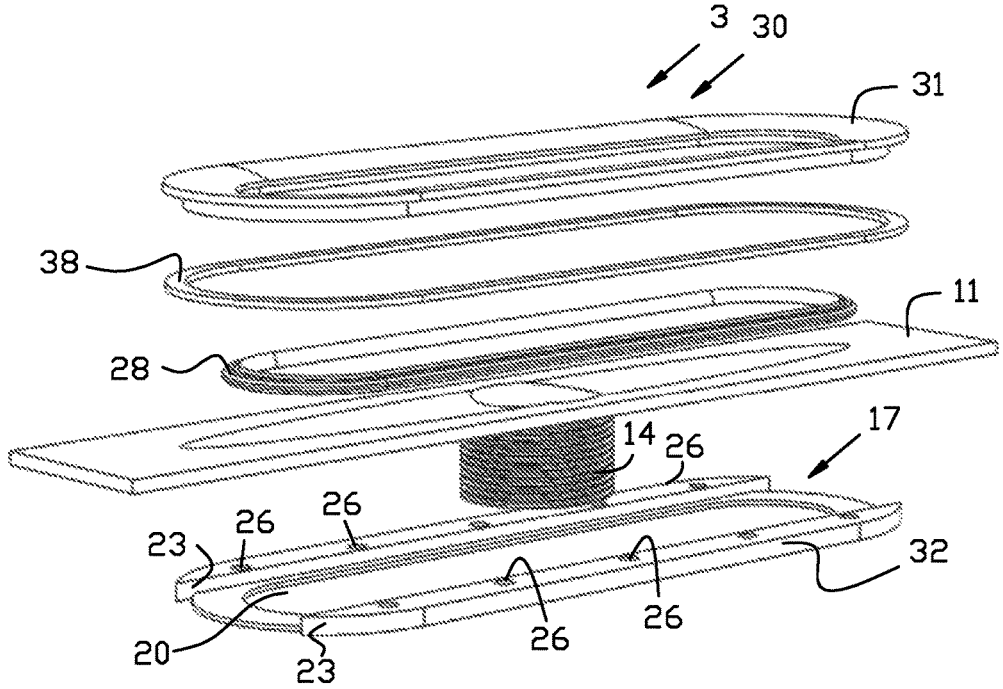
FIG. 6 is an exploded view of the connecting means from FIG. 3, in perspective.
Figure 7:
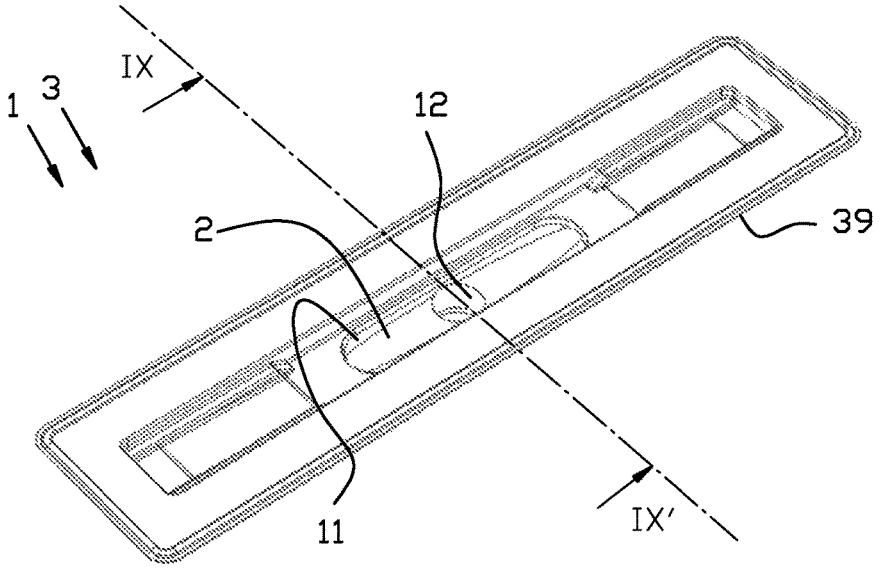
FIGS. 7 and 8 are views in perspective, according to a viewpoint from above and from below respectively, of yet another embodiment of connecting means and a part of a sanitary installation according to the invention.
Figure 8:
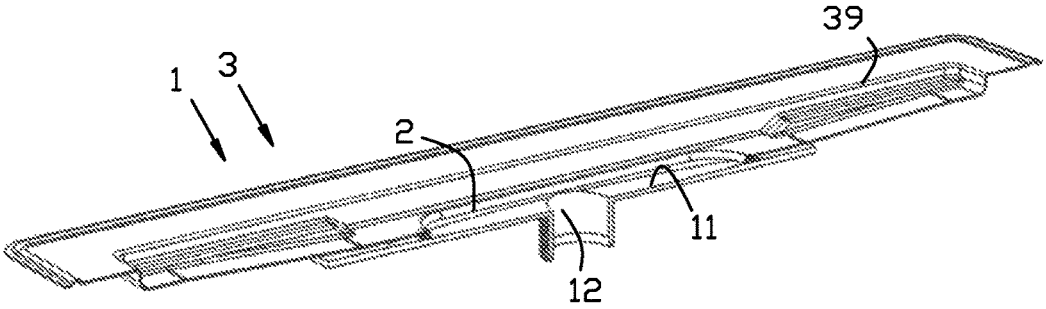
Figure 9:
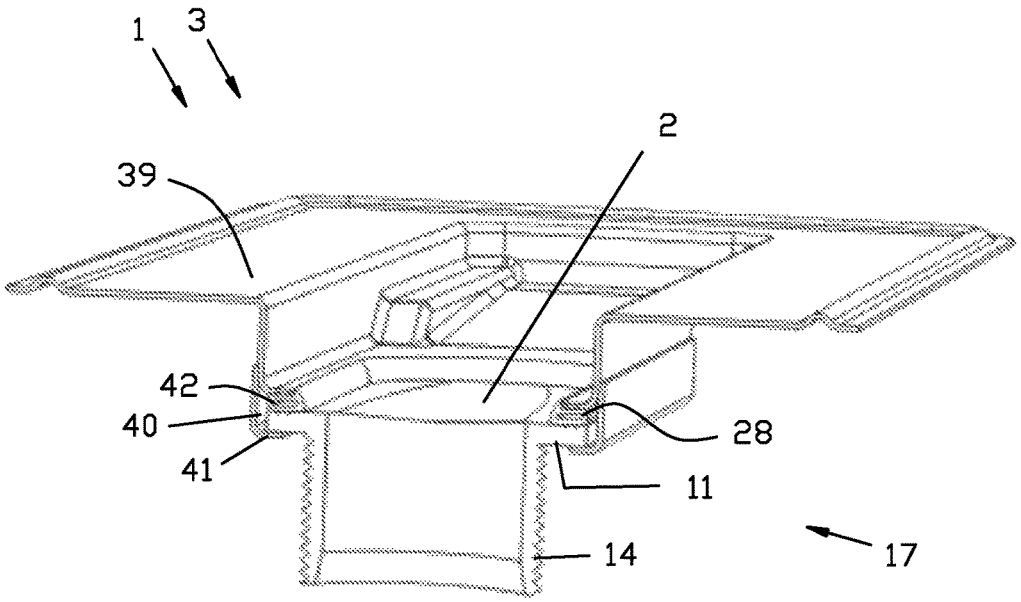
FIG. 9 shows a cross-section in perspective according to line IX-IX' of the connecting means from FIG. 7; and, FIG. 10 shows an exploded view in perspective of the connecting means from FIG. 7.
Figure 10:
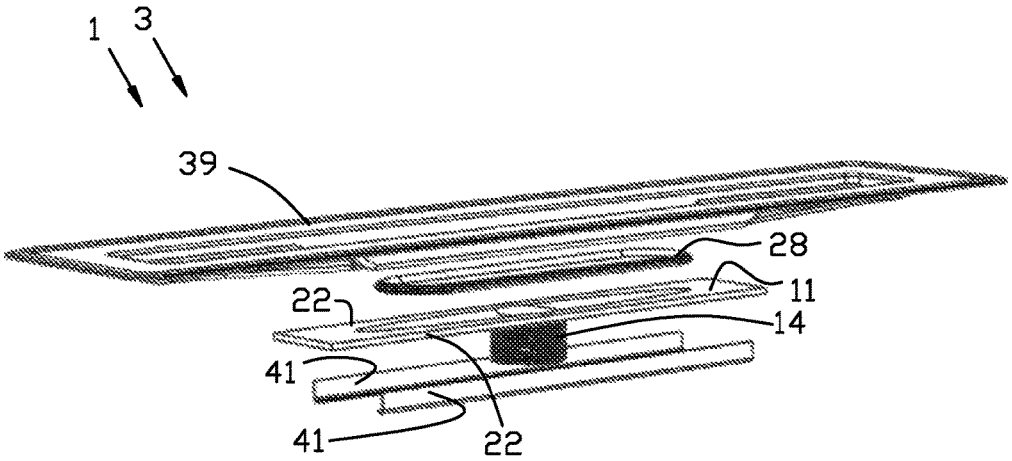

The embodiment of a sanitary installation 1 according to the invention as represented in FIGS. 1 and 2 has a discharge opening 2 onto which are provided connecting means 3 according to the invention designed for connecting a discharge pipe, not represented in the figures, to the discharge opening 2.

The sanitary installation 1 is only shown in part, but it may be a shower or a wash basin for example, whereby the discharge opening 2 is designed in this case as an elongated, oval hole 2 with a length L and a width B provided in a plane or a bottom 4 of the sanitary installation 1 and which serves to collect water.

The aforesaid plane 4 or the aforesaid bottom 4 may be a part of a basin but for example also the tiled floor of a walk-in shower or the like.

In other embodiments it is not even excluded to provide the discharge opening 2 in a section that is not directly part of a sanitary installation 1, but which section is meant to be integrated in such sanitary installation 1.

An extreme example might be a cloth, for example, in which is provided a hole, whereby the cloth is meant to be incorporated in the underfloor of a sanitary installation 1.

The aforesaid plane 4 or the aforesaid bottom 4 is preferably provided with inclined portions 5 which slope down in the direction of the discharge opening 2 in order to lead the water to be drained to the latter.

In this embodiment, the discharge opening 2, according to the length L, has two parallel edges 6 and 7 and, on each head 8 of the hole 2, at the two longitudinal ends 9 respectively, it has a rounded, semi-circular edge 10.

In the given embodiment of FIGS. 1 and 2, the connecting means 3 comprise a longitudinal cover plate 11 in which is provided a connecting opening 12.

It is hereby intended that the cover plate 11 can cover the contours of the discharge opening 2 and can restrict the drainage of water via the discharge opening to the connecting opening 12 in the cover plate 11.

Said connecting opening 12 is in this case a circular hole with a diameter D which is somewhat smaller than the width B of the discharge opening 2 and it forms the far end 13 of a tube piece 14, whereby the cover plate 11 thus forms a flange 11 of said tube piece 14.

The tube piece 14 is designed to make it easy to connect a discharge pipe consisting of discharge pipes or discharge hoses and traps and the like, and to this end it is provided in this case with external thread 15, but the tube piece 14 can of course also be made smooth.

Naturally, it is likewise possible to provide a trap directly on the cover plate 11 and to manufacture the trap and cover plate 11 as one piece, such that the cover plate 11 forms a flange of said trap as if it were.

Still other embodiments are not excluded from the invention either.

The connecting opening 12 is provided centrally in the cover plate 11, whereby the cover plate 11 is in this case rectangular with a width B' which is somewhat larger than the width B of the discharge opening 2 in the sanitary installation 1.

The length L' of the longitudinal cover plate 11 is substantially larger than the length L of the discharge opening 2 in the sanitary installation 1 in order to make it possible to position the connecting opening 12 by a shift of the cover plate 11 between two extreme positions in the discharge opening 2, more specifically in the vicinity of both longitudinal ends 9 of said discharge opening 2.

To achieve this goal, the distances E as of a far end 16 of the cover plate 11 up to the connecting opening 12, plus the diameter D of the connecting opening 12, must be larger than the length L of the discharge opening 2. In short, E+D must be larger than L to this end.

Embodiments in which this is not the case are not excluded from the invention, however, but they only allow for a limited positioning of the connecting opening 12 in the discharge opening 2.

On the other hand, the connecting opening 12 in the cover plate 11 has dimensions which are substantially smaller than the largest dimension L of the discharge opening 2 in the sanitary installation 1, so that by shifting the cover plate 11 the connecting opening 12 can be positioned in the discharge opening 2.

In this case, the largest dimension of the connecting opening is determined by the diameter D of the circular opening, but connecting openings 12 with other shapes and dimensions are not excluded from the invention.

The connecting means 3 according to the invention also contain a guide 17 in which the cover plate 11 can be provided in such a way that it can move back and forth according to its length L'.

In this case, said guide 17 is formed by a separate guide element 18 which is connectable to the sanitary installation 1 concerned.

More specifically, the guide element 18 in the given embodiment consists of a plate 18 with a rectangular flat part 19 having a width B" corresponding to the width B' of the cover plate 11.

In this flat part 19 is provided a longitudinal through hole 20 in order to allow the tube piece 14 provided on the connecting opening 12 of the cover plate 11 to move along with the cover plate 11 within the contours 21 of the through hole 20 in the guide element 18.

The shape of the through hole 20 in this case largely corresponds to the shape of the discharge opening 2 and has a length L" corresponding to the length L of the discharge opening 2.

According to the invention, the guide 17 in its mounted position further encloses a few opposite, parallel side edges 22 of the cover plate 11 in certain embodiments.

In the embodiment of FIGS. 1 and 2 as discussed here, this is realised by means of two parallel standing edges on the flat part 19 of the guide element 17, which edges 23 allow to mount the flat part 19 at a distance from the bottom 4 corresponding to the thickness T of the cover plate 11, such that the cover plate 11 can be provided sliding back and forth between the flat part 19 and the bottom 4 of the sanitary installation.

In this case is provided a rectangular countersunk 25 on the bottom side 24 of the bottom 4 round the discharge opening 2 enabling to mount the guide element 17 as countersunk in the bottom 4.

In order to mount the guide element 18 on the bottom side 24 of the sanitary installation, the guide element 18 is provided all around with holes 26 to put screws or bolts in which can be screwed down in the bottom 4 of the sanitary installation 1 at a minimal distance from the edges of the discharge opening 2.

According to the invention, the connecting means 3 also contain a seal 27 for directly or indirectly sealing the movable cover plate 11 in relation to the discharge opening 2 of the sanitary installation 1.

Water which is discharged via the discharge opening 2 to a discharge pipe flows over the cover plate 11 to the connecting opening 12 which forms the far end of the discharge pipe and thus ends up in the discharge pipe via said connecting opening 12.

Obviously, the seal 27 is intended to prevent that water might flow away between the cover plate 11 and the sanitary installation 1 without ending up in the connecting opening 12.

In the given example of FIGS. 1 and 2, said seal 27 consists of a dynamic sealing ring 28 provided in a recess 29 surrounding the edges of the discharge opening 2.

The dynamic sealing ring 28 hereby makes direct contact with the bottom 4 of the sanitary installation 1, as well as with the cover plate 11.

It is clear that, after the cover plate 11 has been mounted in the discharge opening 2 using the guide element 18 and the seal 27, the largest part of the discharge opening 2 will be sealed, whereby water can only be discharged via the connecting opening 12 in the cover plate and the tube piece 14.

Thanks to the sliding arrangement of the cover plate 11, however, this connecting opening 12 can be positioned in the discharge opening 2, so that obstacles which might hinder the connection of a discharge pipe can be easily avoided.

In general terms, the aim is that the connecting opening forms the far end of a discharge pipe or trap or the like, either during the manufacturing stage of the connecting means or after a discharge pipe has been connected to the cover plate 11, such that by shifting the cover plate 11 in the discharge opening 2, the position of the far end of the discharge pipe or the trap or the like can be altered.

In the embodiment discussed here, the guide 17 is formed of a guide element 18 to be mounted separately, but in other embodiments it is not excluded for the guide 17 to be part of the sanitary installation 1 itself.

Also, in the embodiment of FIGS. 1 and 2, the connecting means 3 form a separate connection set 30 according to the invention with which a discharge opening 2 of the sanitary installation 1 having a fixed position can be largely closed off, with the exception of a positionable connecting opening 12 via which water can be drained.

FIGS. 3 to 6 represent yet another connection set 30 according to the invention, forming the connecting means 3 according to the invention, whereby the connection set 30 again includes a guide 17 in the shape of a separate guide element 18 which can be connected to the sanitary installation 1 concerned.

In this embodiment, the guide element 18 is made in two parts, however, more specifically with a top part 31 and a bottom part 32.

The bottom part 32 has a shape which is entirely analogous to the shape of the guide element 18 from the preceding example, with a flat part 19 onto which are provided two parallel, standing edges 23, in which edges 23 are provided holes 26, which this time are designed to screw down the bottom part 32 to the top part 31, however.

It is therefore not excluded of course to apply the bottom part 32 of this embodiment as separate, as illustrated in FIGS. 1 and 2, without using the top part 31.

The top part 31 consists of an annular element 31 which is provided with a circumferential recess 34 on its outer circumference 33, which allows to clasp the protruding edges of a discharge opening 2 in a sanitary installation 1 between the bottom part 32 and the top part 31, whereby these edges are contained in the recess 34.

On the inner circumference 35 of the top part 31 is also provided a circumferential recess 36 which is similar to the recess 29 on the discharge opening 2 in the preceding example and in which can be provided a dynamic sealing ring 28.

In the preceding embodiment just as in the embodiment of the connecting means 3 discussed here, the dynamic sealing ring 28 is visibly provided in the circumferential recess 36, and the sealing ring 28 forms the boundary as if it were between the top part 31 and the cover plate 11.

Further, the annular top part 31 also has an annular foot 37, situated centrally between the outer circumference 34 and the inner circumference 35 and which can subsequently be applied against the standing edges 23 of the bottom part 32 in order to be able to screw both parts 31 and 32 together.

The connection set 30 also includes a cover plate 11 having the same shape as in the preceding example of FIGS. 1 and 2, whereby this cover plate 11 is this time designed to be fitted in a sliding manner between the two parts 31 and 32 of the guide element 18.

Unlike in the previous example, the connection set 30 in the embodiment of FIGS. 3 to 6 is provided with two seals instead of merely one.

More specifically, a static seal in the shape of a static sealing ring 38 is provided on the one hand which can be provided in the recess 34 to seal the guide element 18 in relation to the discharge opening 2 in the sanitary installation 1, and a dynamic seal in the shape of a dynamic sealing ring 28 on the other hand to directly seal the cover plate 11 in relation to the guide element 18 and thus to indirectly seal it in relation to the discharge opening 2 of the sanitary installation 1.

In short, the connection set 30 from FIGS. 3 to 6 forms connecting means 3 according to the invention which can be clamped in a discharge opening 2 of a sanitary installation 1, which is useful for example in case the sanitary installation 1 is not of such a nature that a guide element 18 having the shape as in FIG. 1 can be fixed to the latter by means of screws or bolts. This is for example typically the case with shower trays or sinks consisting of a thin metal plate.

FIGS. 7 to 10 represent yet another embodiment of connecting means 3 according to the invention, this time meant for a sanitary installation 1 in the shape of a walk-in shower, whereby water is discharged via a metal discharge groove 39 built-in in the floor of the walk-in shower.

In the embodiment shown, the guide 17 is integrated in the discharge groove 39.

Said guide 17 is formed of a pair of parallel slits 40 extending on either side of the discharge opening 2 in the discharge groove 39.

These slits 40 are obtained by applying a pair of profiles 41 with an L-shaped section under the edges 42 concerned of the discharge groove 39 which are also inwardly folded.

The cover plate 11 can thus be slidably mounted in the slits 40, whereby a dynamic sealing ring 28 is provided against the cover plate 11 on the one hand, and is provided directly on the sanitary installation 1 around the discharge opening 2 on the other hand.

In another embodiment, the dynamic seal 27 may be formed of a dynamic sealing ring 28 sealing the cover plate 11 indirectly in relation to the discharge opening 2 of the sanitary installation 1, whereby the sealing ring 28 is provided against the cover plate 11 on the one hand, and is provided directly on a guide element 17 surrounding the discharge opening 2 in the sanitary installation 1 on the other hand, whereby this guide element 17 is statically sealed itself in relation to the discharge opening 2.

Figure 11:
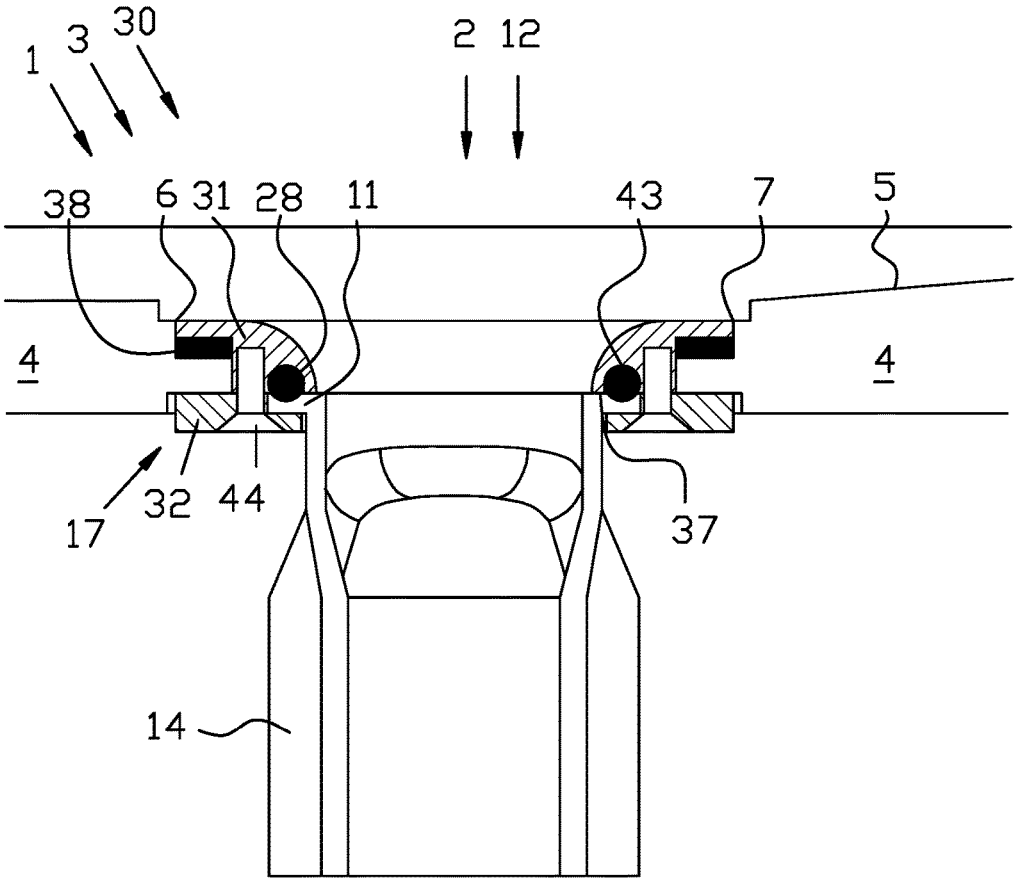
FIG. 11 shows a frontal view of a cross-section through a sanitary installation and the accompanying connecting means, similar to the section represented in FIG. 4, but for yet another embodiment according to the invention of the connecting means concerned.

FIG. 11 shows yet another cross-section of connecting means 3 according to the invention which differ slightly from the embodiment represented in FIGS. 3 to 6.

In the embodiment of FIG. 11 is also applied a dynamic sealing ring 28 which is not flat but which has a circular cross-section.

It is therefore not excluded according to the invention to use various other types of seals, either a seal in the shape of rubber sealing rings having yet another cross-section or the like, or a seal in any other shape whatsoever.

Another difference with the preceding embodiments consists in that in the embodiment of FIG. 11, the round dynamic sealing ring 28 is embedded in a gutter 43 which is provided in the foot 37 of the top part 31 and which is directed to the cover plate 11.

Thus, the sealing ring 28 is not provided in a recess 36 provided on the inner circumference 35 of the het top part 31, as in the preceding cases.

Thus is obtained an embodiment in which the seal between the guide 17 and the cover plate 11 is withdrawn from view.

In FIG. 11, the tube piece 14 which is provided on the connecting opening 12 is made smooth on the outside.

In yet other embodiments it is not excluded either to provide a guide 17 in which the cover plate 11 cannot only be provided moving back and forth according to its length L', but in which the cover plate 11 can also move somewhat back and forth according to its width B'.

For example, a little shift of the cover plate according to its width B' of typically around 1 cm is admissible, further facilitating the correct positioning of the connecting opening 11 in the discharge opening 2, while the advantage of the compact dimensions of connecting means 3 according to the invention remains.

Connecting means 3 or a sealing set 30 according to the invention can be applied in all sorts of sanitary applications such as for example in a surface-mounted shower tray, a built-in shower tray, a walk-in shower, a sink, a bath tub or a kitchen sink and the like.

The invention is by no means limited to the embodiment of connecting means 3 for connecting a discharge pipe onto a discharge opening 2 of a sanitary installation 1, described by way of example only and illustrated by means of the drawings, as well as a of connection set 30 forming such connecting means 3 and of a sanitary installation 1 with a discharge opening 2 onto which a discharge pipe is connected by means of such connecting means 3; on the contrary, such connecting means 3, such a connection set 30 and such a sanitary installation 1 can be obtained in various other ways while still remaining within the scope of the invention.

The invention claimed is:

1. Connecting means (3) for connecting a discharge pipe to a discharge opening (2) of a sanitary installation (1) said connecting means (3) comprising:

a longitudinal cover plate (11) including a connecting opening (12) capable of connection to the discharge pipe;

a guide (17) located and sized to receive and permit axial movement of the cover plate in a horizontal plane to and fro within the guide according to a length (L') of the cover plate; and, a dynamic sealing ring (28) located above, and in direct contact with., the cover plate and capable of providing a seal between the cover plate in relation to the discharge opening (2) of the sanitary installation (1); and wherein the axial movement of the cover plate within the guide positions the connecting opening relative to the discharge opening (2) of the sanitary installation.

2. The connecting means (3) according to claim 1 wherein the connecting opening (12) is provided centrally in the cover plate (11).

3. The connecting means (3) according to claim 1 wherein the connecting opening (12) in the cover plate (11) forms a far end (13) of a tube piece (14), whereby the cover plate (11) thus forms a flange of said tube piece (14).

4. The connecting means (3) according claim 1, wherein the guide (17), in a mounted position, encloses a pair of opposite, parallel side edges (22) of the cover plate (11).

5. The connecting means (3) according to claim 4, wherein the guide (17) comprises a flat part (19) having a width (B") corresponding to a width (B') of the cover plate (11), and a longitudinal through hole (20) is provided in the flat part (19) to allow a tube piece (14) provided on the connecting opening (12) of the cover plate (11) to move along with the cover plate (11) within contours of the through hole (20) in the guide (17).

6. The connecting means according to claim 1, wherein the installations are selected from the group consisting of:

a surface-mounted shower tray;

a built-in shower tray;

a walk-in shower;

a sink;

a bath tub; or a kitchen sink.

7. The connecting means (3) according to claim 1 wherein the cover plate (11) can cover the contours of the discharge opening (2) and can restrict the drainage of water via the discharge opening (2) to the connecting opening (12) in the cover plate (11).

8. The connecting means (3) according to claim 1, wherein the connecting opening (12) is intended for forming the far end of the discharge pipe or trap, either during the manufacturing stage of the connecting means (3) or after the discharge pipe has been connected to the cover plate (11), such that by shifting the cover plate (11) in the discharge opening (2), the position of the far end of the discharge pipe or the trap or the like can be altered.

9. The connecting means (3) according to claim 1, wherein the connecting means (3) are such that the location of the connection to the discharge pipe at a bottom of the sanitary installation (1) can be altered, whereas the discharge opening (2) remains unchanged.

* * * * *